US007815209B2

(12) United States Patent
Porcheron

(10) Patent No.: US 7,815,209 B2
(45) Date of Patent: Oct. 19, 2010

(54) VERTICALIZING CHAIR WITH CONTROL MEANS FOR CONTROLLING THE ANGLE OF THE FOOT REST IN VERTICAL POSITION

(75) Inventor: Francois Porcheron, Lyons (FR)

(73) Assignee: Lifestand "Vivre Debolt", Les Echets (FR)

( * ) Notice: Subject to any disclaimer, the term of this patent is extended or adjusted under 35 U.S.C. 154(b) by 878 days.

(21) Appl. No.: 11/523,065

(22) Filed: Sep. 19, 2006

(65) Prior Publication Data

US 2007/0063480 A1 Mar. 22, 2007

(30) Foreign Application Priority Data

Sep. 20, 2005 (FR) ..... 05 09588

(51) Int. Cl.
*A61G 5/10* (2006.01)

(52) U.S. Cl. ..... 280/304.1; 280/250.1; 280/650

(58) Field of Classification Search ..... 280/639, 280/250.1, 304.1, 650, 647, 657; 180/65.1, 180/907

See application file for complete search history.

(56) References Cited

U.S. PATENT DOCUMENTS 3,379,450 A * 4/1968 Jones et al. ..... 280/657
4,231,614 A * 11/1980 Shaffer ..... 297/330
4,809,804 A 3/1989 Houston et al.
5,108,202 A * 4/1992 Smith ..... 297/330
5,137,295 A * 8/1992 Peek ..... 280/304.1
5,346,280 A * 9/1994 Deumite ..... 297/330
5,556,121 A * 9/1996 Pillot ..... 280/304.1
5,609,348 A 3/1997 Galumbeck
5,772,226 A * 6/1998 Bobichon ..... 280/250.1
5,884,935 A 3/1999 Tholkes
5,984,338 A 11/1999 Meyer
6,976,698 B2 * 12/2005 Kuiken ..... 280/647
7,165,778 B2 * 1/2007 Kuiken ..... 280/250.1
2002/0027334 A1 * 3/2002 Porcheron ..... 280/250.1

FOREIGN PATENT DOCUMENTS

EP 1275363 1/2003
FR 2529456 1/1984
FR 2717377 9/1995

* cited by examiner

*Primary Examiner*—S. Joseph Morano
*Assistant Examiner*—Bridget Avery
(74) *Attorney, Agent, or Firm*—Clark & Brody

(57) ABSTRACT

The invention concerns a standing wheelchair for handicapped and invalid people, that includes a chassis supporting an articulated structure which includes a seat support structure, a footrest support structure, a backrest support structure, and support and maneuvering resources of the articulated structure. The support and maneuvering resources are located between the articulated structure and the chassis and which are designed to move the articulated structure from a sitting position to a standing position set back in relation to the sitting position, and vice versa. According to the invention, the standing wheelchair includes resources for setting the angle (α) between the footrest and the seat in the standing position.

11 Claims, 2 Drawing Sheets

VERTICALIZING CHAIR WITH CONTROL MEANS FOR CONTROLLING THE ANGLE OF THE FOOT REST IN VERTICAL POSITION

This present invention concerns wheelchairs, more particularly but not exclusively, wheelchairs that are used by handicapped and invalid people, and it covers all wheelchairs, whether folding or not, without distinction.

It is undeniable that wheelchairs have given the possibility of mobility to handicapped and invalid people. However these wheelchairs have several drawbacks associated with the fact that the users can occupy only a sitting position, in which they must remain for relatively long periods.

Such a position is not suitable for all aspects of day-to-day living, and does not facilitate social contact. Moreover, such a sitting position, when occupied for relatively long periods, is responsible for physical degradation, such as loss of angular amplitude of the lower limbs, poor blood circulation, slowing of the digestive and intestinal functions, fragility of the bones, and so on.

In order to remedy the above drawbacks, armchairs have been proposed whose chassis supports an articulated structure that includes a backrest, a seat and a footrest. Such a structure is assembled to be articulated by the seat on a horizontal frontal axis, perpendicular to vertical plane of symmetry of the chassis. The articulated structure can be controlled with full or assisted motor drive, in order to move the seat from a lowered position to a raised position and vice versa. Such chairs are generally described at "standing wheelchairs" or "verticalizing chair".

Whether the power source, controlling or used to control the raising and lowering of the articulated structure, is based on electrical energy, elastic actuators, gas-operated in particular or purely manual, armchairs of the above type have certainly, for the most part, solved the drawbacks arising from the use of a conventional chair.

This has certainly been the reason for the success of such chairs for quite a number of years now. By way of reference, it is possible to mention patent FR 2 529 456, which relates precisely to such a design for a standing wheelchair.

Although they give satisfaction, it seems that such chairs have given rise to an objection concerning convenience and comfort, relating in particular to the fact that it is not possible to move about in a chair as described by patent FR 2 529 456, when it is in the standing position.

In order to remedy this disadvantage, patent FR 2 717 377 proposed a standing wheelchair that includes a chassis with motor-driven wheels, supporting an articulated structure which itself has a structure supporting a seat, a structure supporting a footrest and a structure supporting a backrest. The wheelchair also includes resources to support and manoeuvre the articulated structure, these being located between the articulated structure and the chassis, and being designed to move the articulated structure from a sitting position to a standing position and vice versa. The particular feature of patent FR 2 717 377 concerns the fact that, in the standing position, firstly, the articulated structure is set back in relation to the sitting position or recentred in relation to the chassis and, secondly, the footrest is positioned at a distance from the ground so that the chair is very stable and is able to move about in this standing position.

In use, however, it appears that this last type of chair has not always been able to guarantee its user with the maximum of comfort and convenience and a feeling of security in the standing position. The applicant did have the merit of pointing out that comfort and the feeling of security were mostly obtained through bending of the knees in the standing position, though this advice was for users who have never had use of their lower limbs and/or whose lower limbs are atrophied.

Thus, the invention concerns a standing wheelchair for handicapped and invalid people, including a chassis supporting an articulated structure that in turn includes a seat support structure, a footrest support structure, a backrest support structure, and resources to support and manoeuvre the articulated structure which are located between the articulated structure and the chassis, and which are designed to move the articulated structure from a sitting position to a standing position that is set back in relation to the sitting position, and vice versa.

According to the invention, and in order to allow a bending adjustment of the knees to suit the user, the standing wheelchair is characterized in that it includes resources for setting the angle between the footrest and the seat in the standing position, and for adjusting the amplitude of the relative rotation between the seat support structure and the footrest support structure when standing. The use of such adjusting resources reinforces the feeling of security of the user, in particular when the knees have to make use of lower limb retention resources such as knee supports.

According to the invention, the adjustment resources can be provided in any appropriate manner. Thus, when the footrest support resources are articulated in relation to the seat support resources, the adjustment resources can consist of a cam or connecting-rod linking the footrest support structure to the seat support structure. In a preferred form of implementation, the adjustment resources include an adjustable end-stop against which the footrest support structure bears in the standing position.

According to the invention, the structures supporting the seat, the footrest and the backrest can be implemented in various ways, and as described in patent FR 2 717 377 for example.

According to a preferred form of implementation of the invention, the seat support structure includes at least one first deformable four-bar linkage, composed of two bars, upper and lower respectively, forming the long sides of the four-bar assembly, which are articulated, firstly, toward their front parts on a front distance piece corresponding to the front short side of the four-bar assembly and, secondly, toward their rear parts by a rear distance piece, corresponding to a rear short side. According to this preferred form of implementation, the resources to support and manoeuvre the articulated structure include, firstly, at least one second deformable four-bar assembly composed of two connecting rods, upper and lower respectively, with the upper connecting rod being articulated toward the rear on the chassis and toward the front on the upper bar of the first four-bar assembly, and with the lower connecting rod being articulated toward the rear on the chassis and toward the front on the lower bar of the first four-bar assembly and, secondly, a motor-driven actuator, located between the chassis and an element attached to the lower bar or the upper bar of the first four-bar assembly. The footrest structure includes at least one upright which is connected to the front distance piece and which, in the standing position, bears against the adjustment resources formed by an end-stop attached to the chassis, while the backrest support structure is articulated toward the rear on the first four-bar assembly, opposite to the footrest, and which includes at least one upright supporting the backrest.

In a preferred form of implementation, the seat support resources and the resources that support and manoeuvre the articulated structure will each include two lateral assemblies which are more or less parallel.

According to one characteristic of the invention, and in the context of its preferred forms of implementation, the upright of the footrest support structure is linked in a rigid manner to the front distance piece or pieces of the seat support structure.

According to another characteristic of the invention, the standing wheelchair includes stabilization resources which are mobile between a retracted position and a deployed position in which they are extended at the footrest and come into contact with the ground, and which are controlled to be in the deployed position when the articulated structure is in the standing position, and in the retracted position when the articulated structure is in the sitting position.

According to yet another characteristic of the invention, the backrest support structure includes a motor-driven actuator which is articulated on the seat support structure, and which is used to adjust the slope of the backrest in relation to the seat.

The different characteristics of the invention can be employed with each other in various combinations as long as these are not incompatible.

In addition, various other characteristics of the invention emerge from the following description, provided with reference to the appended drawings which illustrate different non-limiting forms of implementation of a standing wheelchair according to the invention, and which have resources for setting the angle between the footrest and the seat in the standing position.

Figure 1:
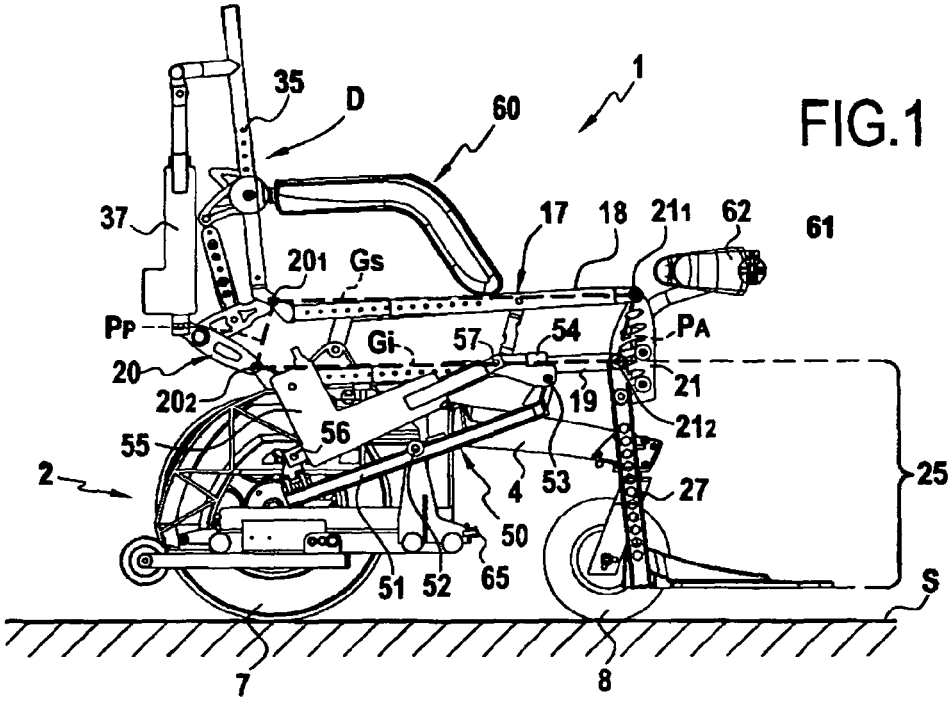
FIG. 1 is an elevation, of the right side in partial section, of a chair according to the invention, in the sitting or lowered position of the chair.

The invention concerns a standing or verticalizing wheelchair, as illustrated in FIGS. 1 to 4, and designated as a whole by the reference 1, capable of moving in the standing position and intended to provide the best possible security to its user.

Such a chair 1 includes a chassis 2, composed of lateral half-chassis 3 and 4, joined together by cross members 5 and 6. The chassis 2 is equipped, in a normally familiar manner, with wheels 7, generally load-bearing, principal and powered, and with steerable wheels 8, that are steered by means of pivots 9. The wheels 8 are generally, but not necessarily, positioned on the front part of the chassis 2, while the load-bearing wheels 7 occupy the rear part. By their contact points on the ground S, the wheels 7 and 8 form a bearing or lifting polygon through the centre of which there passes a vertical axis X-X'. The wheels 7 can advantageously be associated with reversible electric drive motors (not shown) capable of being powered from a chair-mounted source (also not shown).

Figure 2:
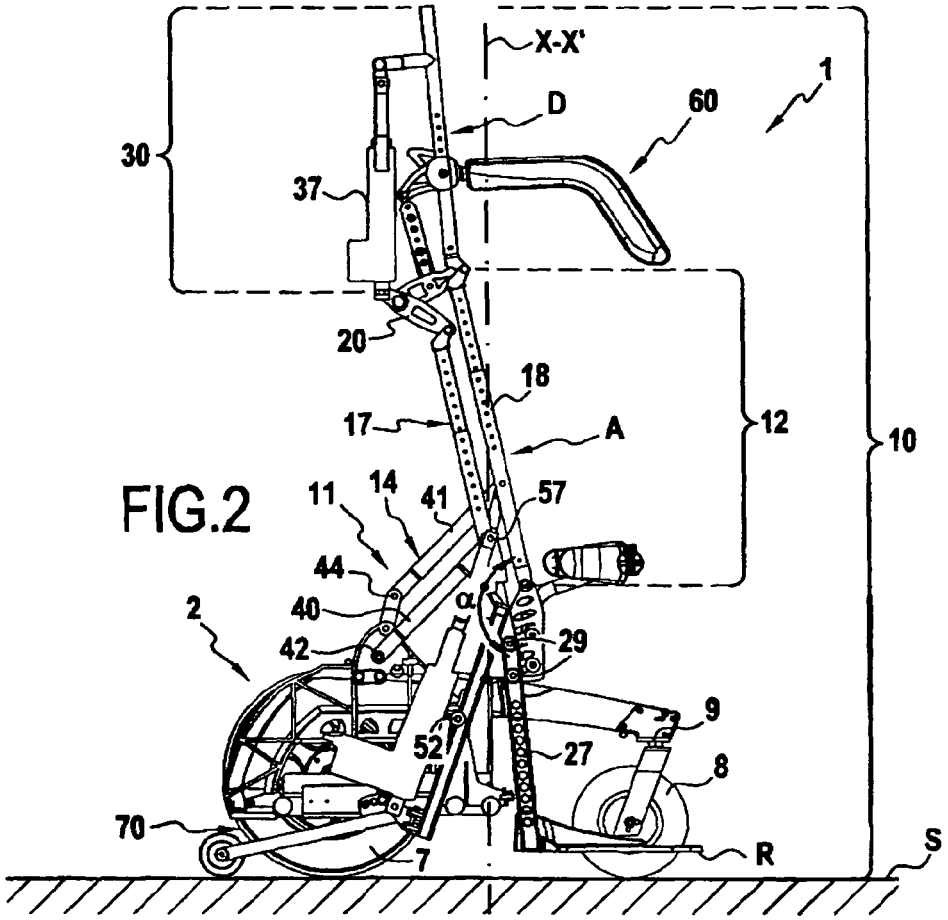
FIG. 2 is an elevation, of the right side in partial section, of the chair according to FIG. 1, in the standing or raised position.
Figure 3:
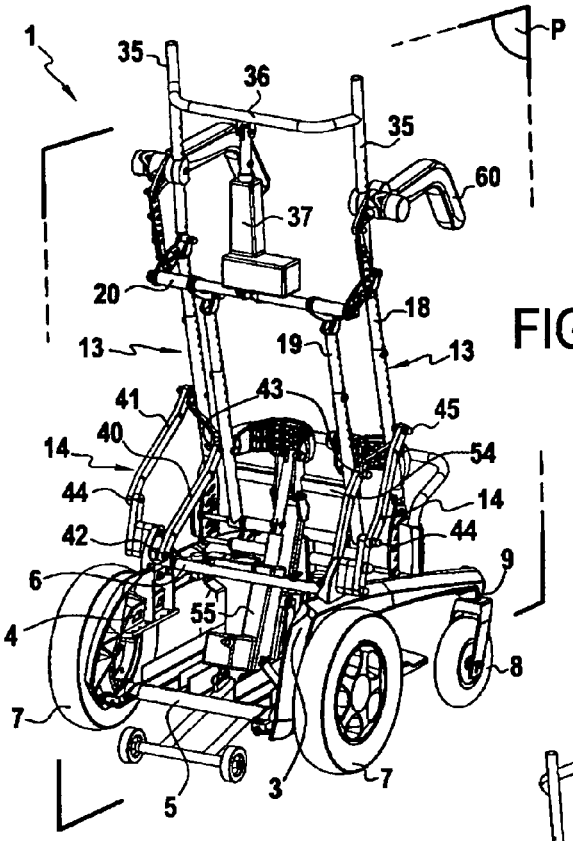
FIG. 3 is a three quarters right rear perspective view of the chair according to FIGS. 1 and 2, in the standing position.
Figure 4:
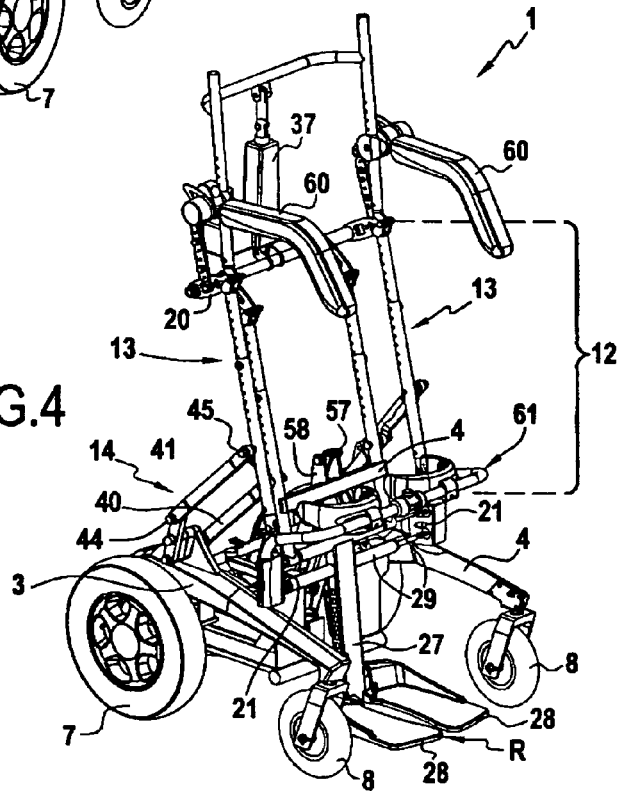
FIG. 4 is a three quarters right front perspective view of the chair according to FIGS. 1 and 2, in the standing position.

The chassis 2 supports an articulated structure 10, holding a seat A, a backrest D and a footrest R, organized so that they can maintain a stable position when folded, corresponding to a position described as sitting, as illustrated in FIG. 1, and a stable position when unfolded, corresponding to a standing position, as illustrated in FIG. 2. In these two positions, and by means of resources known in the trade (and not shown), the articulated structure is designed to support a handicapped or invalid person in a sitting position and in a standing position respectively. It will be seen that, in the standing position, the articulated structure 10 is more or less aligned with the vertical axis X-X', and is recentred in relation to its situation in the sitting position.

The articulated structure 10 is connected to the chassis 2 by support and maneuvering resources 11. The articulated structure 10 includes a structure 12 to support the seat A. According to the illustrated example, the support structure 12 is composed of two lateral articulated systems 13, which are symmetrical in relation to a central front-to-back plane P and which are more particularly visible in FIGS. 3 and 4. Each articulated system 13 is intended to be adapted laterally to the chassis 2, to each of the half-chassis 3 and 4 for example, by means of two lateral assemblies 14, that constitute the support and maneuvering resources 11.

Each articulated system 13 includes a first deformable four-bar linkage 17, composed of upper bars 18 and lower bars 19, although, in the representation illustrated in FIGS. 1 to 4, these are not located in the same vertical plane. The bars 18 and 19 are joined at their rear end part, by an element or a rear distance piece 20, to which they are linked by pivots $\mathbf{20}_1$ and $\mathbf{20}_2$. The bars 18 and 19 are also joined at their front end parts by a front distance piece 21 to which they are linked by pivots $\mathbf{21}_1$ and $\mathbf{21}_2$.

Thus, the lower 19 and upper 18 bars, and their respective articulation points $\mathbf{20}_1$, $\mathbf{21}_1$, $\mathbf{20}_2$, $\mathbf{21}_2$, form the upper $G_S$ and lower $G_I$ long sides, while the rear distance piece 20 forms a rear short side $P_P$ of the first four-bar assembly, with the front distance piece 21 forming a front short side $P_A$, as can be seen in FIG. 1.

The articulated structure 10 also includes a structure 25 to support the footrest R, which includes a descender or upright 27, which is intended to support two plates 28 forming the footrest. The upright 27 is linked in a rigid manner to the rear distance pieces 21 by means of cross members 29.

The articulated structure 10 finally includes a structure 30 to support the backrest D. This structure 30 includes two uprights 35, each articulated on the first four-bar assembly 17, at the pivot 20, of the rear distance piece 20. According to the illustrated example, the backrest uprights 35 are also linked by a cross member 36. The backrest support structure 30 also includes a motor-driven actuator 37 linking cross member 36 to the rear distance pieces 20 and are used to adjust the slope of the uprights 36 and therefore of the backrest.

In order to allow passage of the articulated structure 12 from the sitting position, as illustrated in FIG. 1, to the upright or standing position, as illustrated in FIG. 2, the support and maneuvering resources 11 include, firstly, the two lateral assemblies 14 which each connects a lateral assembly 13 to resources 10 to support the seat on the chassis. Each lateral assembly 14 includes a second deformable four-bar assembly composed of two connecting rods, known respectively as the lower 40 and upper 41 bars, although these are not located in the same vertical plane. Each lower connecting rod 40 is then linked, firstly, to the chassis 2 by means of pivot 42 and, secondly, to the lower bar 19 by means of pivot 43. In the same way, each upper connecting rod 41 is linked, firstly, to the chassis 2 by means of pivot 44 and, secondly, to the upper bar 18 by means of pivot 44. The support and manoeuvring resources 11 include a manoeuvring assembly 50, located between the chassis 2 and the seat support structure 12. Thus, the manoeuvring assembly 50 includes a crossbar 51, which is articulated on a cross member 52 attached to the chassis, and linked at one of its ends, by a pivot 53, to a cross member 54 linking the two lower bars 19. The manoeuvring assembly 50 also includes a motor-driven actuator 55 which is articulated, firstly, by a pivot 56 on the end of the crossbar 51 opposite to pivot 53 and, secondly, by a pivot 57 to an arm 58 attached to the cross member 54. Thus, the pivots 52, 53, 57 and 56 form a deformable four-bar assembly by lengthening or shortening the side formed by the motor-driven actuator 55.

The chair 1 finally includes armrests 60, fixed to the uprights 35 and capable of forming a chest support element. The chair 1 also includes bottom retention resources 61, formed by knee supports or shells 62 fixed to the front distance pieces 21 and shaped to enclose the knees or the lower thighs just above the knees, of a person using the chair.

When a user seated in the chair 1 wishes to move from a sitting position, corresponding to FIG. 1, to a standing or upright position, as illustrated in FIG. 2, he or she controls the operation of the electric actuator 55 which, by lengthening, leads to raising of the articulated structure 10. On completion of this movement, the upright 27 of the support resources 25 for the footrest R bear against the chassis 2. According to an essential characteristic of the invention, the chair 1 includes adjusting resources 65 which are used to determine the movement amplitude of the upright 27 during the raising motion, and therefore the angle $\alpha$ between the upright 27 and the upper bar 18 in the standing position of the articulated structure 10. According to the illustrated example, the adjustment resources 65 are formed by a screw whose extension is adjustable, and on which the upright 27 bears. Thus, by adjusting this screw, it is possible to adjust the value of the angle $\alpha$ in the standing position, and therefore the rotation amplitude of the upright 27 in relation to the upper bars 18 when standing. According to their adjustment, resources 65 allow one to achieve a greater or lesser bending of the legs of the user in the standing position. This leg-bending adjustment allows one to determine the manner in which the legs of the user rest in the shells 62, which, firstly, provides stability to the position of the user and, secondly, gives a feeling of confidence to the user. In addition, by acting on the electric actuator 37, it is possible to change the slope of the backrest, and therefore of the user's torso, considerably improving the comfort of the latter.

It will be noted that, in the preferred form of implementation illustrated, the chair 1 also includes stabilization resources 70 which are mobile between a retracted position, as illustrated in FIG. 1, and a deployed position, as illustrated in FIG. 2, in which they are extended opposite to the footrest R and come into contact with the ground S. These resources 70 are controlled so that they are in the retracted position when the articulated structure 10 is in the sitting position, while, when the articulated structure 10 is in the standing position, these resources 70 are in the deployed position and in contact with the ground.

As can be appreciated, various modifications can be made to the invention without moving outside of its scope.

The invention claimed is:

1. A standing wheelchair for handicapped and invalid people, that includes a chassis (2) supporting an articulated structure (10) which itself includes a seat support structure (12), a footrest support structure (25), a backrest support structure (30), and resources (11) to support and maneuver the articulated structure which are located between the articulated structure (10) and the chassis (2) and which are designed to move the articulated structure (10) from a sitting position to a standing position that is set back in relation to the sitting position, and vice versa, characterized in that it includes resources (65) for adjusting the angle ($\alpha$) between the footrest and the seat in the standing position, and for adjusting the amplitude of the relative rotation between the seat support structure and the footrest support structure when standing, said adjustment resources (65) include an adjustable end-stop against which the support structure (25) of the footrest bears in the standing position and said support structure (25) of the footrest including at least one upright (27) which is connected to a front distance piece (21) and which, in the standing position, bears against the adjustment resources (65) formed by the adjustable end-stop attached to the chassis (2), and further characterized in that the support structure (12) of the seat, which includes at least one first deformable four-bar linkage (17) composed of two bars, known respectively as upper (18) and lower (19) bars, forming the long sides ($G_S$, $G_I$) of the four-bar assembly, which are articulated firstly toward their front parts on a front distance piece (21) corresponding to the front short side ($P_a$) of the four-bar assembly and, secondly, toward their rear parts by a rear distance piece (20), corresponding to a rear short side ($P_P$)

the support and of maneuvering resources (11) of the articulated structure include, firstly, at least one second deformable four-bar assembly (14), composed of two connecting rods, known respectively as the lower (40) and upper (41) rods, with the upper connecting rod (41) being articulated toward the rear on the chassis (2) and toward the front on the upper bar (18) of the first four-bar assembly, and with the lower connecting rod (40) being articulated toward the rear on the chassis (2) and toward the front on the lower bar (19) of the first four-bar assembly and, secondly, a motor-driven actuator (55), located between the chassis (2) and an element (51) attached to the lower bar or the upper bar of the first four-bar assembly, and the backrest support structure (30) is articulated, toward the rear, on the first four-bar assembly (17), opposite to the footrest, and includes at least one upright (36) supporting the backrest.

2. A standing wheelchair according to claim 1, characterized in that:

the seat support resources (12) include two lateral assemblies that each have a first deformable four-bar linkage (17), composed of two bars, known respectively as the upper (18) and lower (19) bars, forming the long sides ($G_S$, $G_I$) of the four-bar assembly, and which are articulated, firstly, toward their front parts on a front distance piece (21) corresponding to the front short side ($P_a$) of the four-bar assembly and, secondly, toward their rear parts by a rear distance piece (20), corresponding to a rear short side ($P_P$), and where the support and maneuvering resources (11) of the articulated structure (10) include two lateral assemblies (14) that each has a second deformable four-bar assembly composed of two connecting rods, known respectively as lower (40) and upper (41) rods, with the upper connecting rod (41) being articulated toward the rear on the chassis and toward the front on the upper bar (18) of the first four-bar assembly of the corresponding lateral assembly of the seat support structure, and the lower connecting rod (40) being articulated toward the rear on the chassis (2) and toward the front on the lower bar (19) of the first four-bar assembly.

3. A standing wheelchair according to claim 1 characterized in that the upright (27) of the footrest support structure is linked in a rigid manner to the front distance piece or pieces (21).

4. A standing wheelchair according to claim 1, characterized in that it includes stabilization resources (70) which are mobile between a retracted position and a deployed position in which they are extended opposite to the footrest and come into contact with the ground, and which are controlled to be, firstly, in the deployed position, when the articulated structure is in the standing position and, secondly, in the retracted position when the articulated structure is in the sitting position.

5. A standing wheelchair according to claim 1, characterized in that the backrest support structure (30) includes a motor-driven actuator (37) which is articulated on the seat support structure (12) and which is used to adjust the slope of the back support.

6. A standing wheelchair according to claim 2 characterized in that the upright (27) of the footrest support structure is linked in a rigid manner to the front distance piece or pieces (21).

7. A standing wheelchair according to claim 2, characterized in that it includes stabilization resources (70) which are mobile between a retracted position and a deployed position in which they are extended opposite to the footrest and come into contact with the ground, and which are controlled to be, firstly, in the deployed position, when the articulated structure is in the standing position and, secondly, in the retracted position when the articulated structure is in the sitting position.

8. A standing wheelchair according to claim 2, characterized in that the backrest support structure (30) includes a motor-driven actuator (37) which is articulated on the seat support structure (12) and which is used to adjust the slope of the back support.

9. A standing wheelchair according to claim 3, characterized in that it includes stabilization resources (70) which are mobile between a retracted position and a deployed position in which they are extended opposite to the footrest and come into contact with the ground, and which are controlled to be, firstly, in the deployed position, when the articulated structure is in the standing position and, secondly, in the retracted position when the articulated structure is in the sitting position.

10. A standing wheelchair according to claim 3, characterized in that the backrest support structure (30) includes a motor-driven actuator (37) which is articulated on the seat support structure (12) and which is used to adjust the slope of the back support.

11. A standing wheelchair according to claim 4, characterized in that the backrest support structure (30) includes a motor-driven actuator (37) which is articulated on the seat support structure (12) and which is used to adjust the slope of the back support.

* * * * *

UNITED STATES PATENT AND TRADEMARK OFFICE

CERTIFICATE OF CORRECTION

PATENT NO. : 7,815,209 B2
APPLICATION NO. : 11/523065
DATED : October 19, 2010
INVENTOR(S) : Porcheron It is certified that error appears in the above-identified patent and that said Letters Patent is hereby corrected as shown below:

Title Page; item 73

Assignee: Lifestand "Vivre Debolt", Les Echets (FR) should read:

Assignee: Lifestand "Vivre Debout", Les Echets (FR)

Signed and Sealed this
Twentieth Day of December, 2011

David J. Kappos

David J. Kappos
*Director of the United States Patent and Trademark Office*